US011084563B1

(12) United States Patent
Pielow et al.

(10) Patent No.: US 11,084,563 B1
(45) Date of Patent: Aug. 10, 2021

(54) TILLER FOR OUTBOARD MOTOR

(71) Applicant: Brunswick Corporation, Mettawa, IL (US)

(72) Inventors: Madalyn G. Pielow, Fond du Lac, WI (US); Paul M. Kraus, Fond du Lac, WI (US); Robert A. Podell, Slinger, WI (US)

(73) Assignee: Brunswick Corporation, Mettawa, IL (US)

( * ) Notice: Subject to any disclaimer, the term of this patent is extended or adjusted under 35 U.S.C. 154(b) by 8 days.

(21) Appl. No.: 16/718,566

(22) Filed: Dec. 18, 2019

(51) Int. Cl.
*B63H 21/21* (2006.01)
*B63B 49/00* (2006.01)
*B63H 20/12* (2006.01)

(52) U.S. Cl.
CPC ..... *B63H 21/21* (2013.01); *B63B 49/00* (2013.01); *B63H 20/12* (2013.01); *B63H 2021/216* (2013.01)

(58) Field of Classification Search
CPC .. B63H 21/21; B63H 20/12; B63H 2021/216; B63B 49/00
See application file for complete search history.

(56) References Cited

U.S. PATENT DOCUMENTS

| | | | |
|---|---|---|---|
| 3,636,911 | A | 1/1972 | Piazza et al. |
| 4,318,699 | A | 3/1982 | Wenstadt et al. |
| D276,811 | S | 12/1984 | Wolfe |
| 4,496,326 | A | 1/1985 | Boda |
| 4,504,778 | A | 3/1985 | Evans |
| 4,521,201 | A | 6/1985 | Watanabe |
| 4,582,493 | A | 4/1986 | Toyohara et al. |
| 4,650,429 | A | 3/1987 | Boda |
| 4,701,141 | A | 10/1987 | Sumigawa |
| D295,867 | S | 5/1988 | Walsh |
| 4,878,468 | A | 11/1989 | Boda et al. |
| 4,895,154 | A | 1/1990 | Bartelt |

(Continued)

FOREIGN PATENT DOCUMENTS

| | | |
|---|---|---|
| EP | 1400720 A2 | 3/2004 |
| JP | 3946315 B2 | 7/2007 |

(Continued)

OTHER PUBLICATIONS

Vaninetti et al, "Tiller for Outboard Motor," Unpublished U.S. Appl. No. 29/610,556, filed Jul. 13, 2017.

(Continued)

*Primary Examiner* — Stephen P Avila
(74) *Attorney, Agent, or Firm* — Andrus Intellectual Property Law, LLP

(57) ABSTRACT

A tiller for an outboard motor powered by an engine includes a tiller body that is elongated along a longitudinal center axis between a proximal end and a distal end. A throttle grip is on the distal end of the tiller body. An idle speed control switch is located on the tiller body adjacent the throttle grip. A microcontroller is located inside the tiller body and is in signal communication with an engine controller of the engine. The idle speed control switch is a momentary switch that can be selectively electrically connected to the microcontroller. In response to actuation of the idle speed control switch, the microcontroller sends a signal to the engine controller to change an idle speed of the engine.

21 Claims, 4 Drawing Sheets

(56) References Cited

U.S. PATENT DOCUMENTS

| | | | | |
|---|---|---|---|---|
| 5,145,427 | A | 9/1992 | Kawai et al. | |
| 5,180,320 | A | 1/1993 | Calamia et al. | |
| D343,625 | S | 1/1994 | Walthall | |
| 5,340,342 | A | 8/1994 | Boda et al. | |
| 5,632,657 | A | 5/1997 | Henderson | |
| D380,478 | S | 7/1997 | Robbins et al. | |
| 5,707,262 | A | 1/1998 | Huntley et al. | |
| 5,756,949 | A | 5/1998 | Sato | |
| 5,797,777 | A | 8/1998 | Tsunekawa et al. | |
| 6,020,563 | A | 2/2000 | Risk, Jr. et al. | |
| 6,093,066 | A | 7/2000 | Isogawa et al. | |
| 6,109,986 | A | 8/2000 | Gaynor et al. | |
| 6,146,221 | A | 11/2000 | Natsume | |
| 6,264,513 | B1 | 7/2001 | Marsh | |
| 6,264,516 | B1 | 7/2001 | McEathron et al. | |
| 6,273,771 | B1 | 8/2001 | Buckley et al. | |
| 6,352,456 | B1 | 3/2002 | Jaszewski et al. | |
| 6,382,122 | B1 | 5/2002 | Gaynor et al. | |
| 6,406,342 | B1 | 6/2002 | Walczak et al. | |
| 6,406,343 | B2 | 6/2002 | Kawai et al. | |
| D460,459 | S | 7/2002 | Hansen | |
| 6,648,703 | B2 | 11/2003 | McChesney et al. | |
| 6,902,450 | B2 | 6/2005 | Ohtsuki et al. | |
| 6,914,202 | B2 | 7/2005 | Sugimoto et al. | |
| 7,090,551 | B1 | 8/2006 | Lokken et al. | |
| D527,737 | S | 9/2006 | Iekura | |
| 7,214,113 | B2 | 5/2007 | Kojima | |
| D552,129 | S | 10/2007 | Steinberg et al. | |
| 7,404,747 | B2 | 7/2008 | Shinde et al. | |
| 7,442,104 | B2 | 10/2008 | Okabe | |
| 7,455,558 | B2 | 11/2008 | Yander | |
| 7,553,206 | B2 | 6/2009 | Hasegawa et al. | |
| 7,666,038 | B2 | 2/2010 | Yomo et al. | |
| D611,501 | S | 3/2010 | Vignau et al. | |
| D611,502 | S | 3/2010 | Vignau et al. | |
| 7,677,938 | B2 | 3/2010 | Wiatrowski et al. | |
| 7,704,110 | B2 | 4/2010 | Wiatrowski et al. | |
| 7,895,959 | B1 | 3/2011 | Angel et al. | |
| 7,976,354 | B2 * | 7/2011 | Kubota | B63H 20/007 440/87 |
| D655,308 | S | 3/2012 | Steinberg | |
| 8,257,122 | B1 | 9/2012 | Holley | |
| 9,004,964 | B2 | 4/2015 | Grez | |
| 9,422,045 | B2 | 8/2016 | Kinpara et al. | |
| 9,694,892 | B1 | 7/2017 | Anschuetz et al. | |
| D794,078 | S | 8/2017 | Vaninetti | |
| D794,079 | S | 8/2017 | Vaninetti et al. | |
| 9,764,813 | B1 | 9/2017 | Zarembka et al. | |
| 9,783,278 | B1 | 10/2017 | Dannenberg et al. | |
| 9,789,945 | B1 | 10/2017 | Vaninetti et al. | |
| D806,752 | S | 1/2018 | Vaninetti et al. | |
| D807,920 | S | 1/2018 | Vaninetti | |
| 10,246,173 | B1 | 4/2019 | Ingebritson | |
| D886,865 | S | 6/2020 | Bailey | |
| 10,723,429 | B1 | 7/2020 | Wiatrowski et al. | |
| 2004/0107789 | A1 | 6/2004 | Peppard | |
| 2004/0121667 | A1 | 6/2004 | Okabe | |
| 2004/0137806 | A1 | 7/2004 | Ohtsuki et al. | |
| 2005/0262958 | A1 | 12/2005 | Kojima | |
| 2009/0075534 | A1 * | 3/2009 | Wiatrowski | B63H 20/12 440/53 |
| 2017/0043787 | A1 * | 2/2017 | Mangette | G05D 1/0223 |
| 2019/0176952 | A1 * | 6/2019 | Clark | B63H 21/21 |
| 2020/0156751 | A1 * | 5/2020 | Skrzypchak | B63H 20/12 |
| 2020/0172220 | A1 | 6/2020 | Chung et al. | |

FOREIGN PATENT DOCUMENTS

| | | | |
|---|---|---|---|
| JP | 4094151 | B2 | 6/2008 |
| JP | 5741259 | B2 | 7/2015 |
| JP | 5927980 | B2 | 6/2016 |

OTHER PUBLICATIONS

Erickson et al., "Tiller Tilt Lock and Automatic Release System," Unpublished U.S. Appl. No. 16/257,380, filed Jan. 25, 2019.

Mercury Marine, 15/20hp EFI Fourstroke Outboard Tiller, tiller handle, available at least as early as Nov. 17, 2017.

Mercury Marine, Big Tiller for 75-300 HP Mercury Outboards, tiller handle, available at least as early as 2018, admitted prior art.

* cited by examiner

TILLER FOR OUTBOARD MOTOR

FIELD

The present disclosure relates to outboard motors, and particularly to tillers for outboard motors.

BACKGROUND

The following U.S. Patents are incorporated herein by reference, in entirety:

U.S. Pat. No. 4,318,699 discloses a sensor that responds to the operation of a marine transportation system to sense on-plane and off-plane conditions of a boat to operate a trim control to automatically position a trimmable drive for a desired boating operation. The preferred embodiment senses engine speed while an alternative embodiment senses fluid pressure opposing boat movement. The drive is moved to an auto-out position at high speeds and to a trimmed-in position at lower speeds.

U.S. Pat. No. 5,340,342 discloses a tiller handle provided for use with one or more push-pull cables innerconnected to the shift and the throttle mechanisms of an outboard marine engine to control the shift and the throttle operations of the engine. The tiller handle includes a rotatable cam member with one or more cam tracks located on its outer surface. Each push-pull cable is maintained within a distinct cam track such that rotating the rotatable cam member actuates the push-pull cables thereby controlling the operation of the shift and the throttle mechanisms of the engine.

U.S. Pat. No. 6,109,986 discloses an idle speed control system for a marine propulsion system that controls the amount of fuel injected into the combustion chamber of an engine cylinder as a function of the error between a selected target speed and an actual speed. The speed can be engine speed measured in revolutions per minute or, alternatively, it can be boat speed measured in nautical miles per hour or kilometers per hour. By comparing target speed to actual speed, the control system selects an appropriate pulse with length for the injection of fuel into the combustion chamber and regulates the speed by increasing or decreasing the pulse width.

U.S. Pat. No. 6,264,513 discloses a wireless remote control system for extending the control functions of the electrically actuated control systems of a boat including a plurality of transmitters and receivers, each transmitter capable of generating a signal on two channels and receiver control responsive to each of the two signals and capable of synthesizing a third control signal from the combination of the two signals.

U.S. Pat. No. 6,273,771 discloses a control system for a marine vessel which incorporates a marine propulsion system that can be attached to a marine vessel and connected in signal communication with a serial communication bus and a controller. A plurality of input devices and output devices are also connected in signal communication with the communication bus and a bus access manager, such as a CAN Kingdom network, is connected in signal communication with the controller to regulate the incorporation of additional devices to the plurality of devices in signal communication with the bus whereby the controller is connected in signal communication with each of the plurality of devices on the communication bus. The input and output devices can each transmit messages to the serial communication bus for receipt by other devices.

U.S. Pat. No. 6,352,456 discloses a marine propulsion apparatus in which a support structure is attached to an internal combustion engine to support the engine and allow the engine to be pivoted about a steering axis. A steering handle is attached to the support structure and the steering handle is rotatable within a range about an axis. A driveshaft housing is attached to the internal combustion engine and a driveshaft is supported within the housing. The apparatus can be raised or lowered relative to a bracket which comprises a support cylinder. The steering handle is adjustable within a range of travel and the entire marine apparatus can be raised or lower to accommodate various different types of marine vessels.

U.S. Pat. No. 6,382,122 discloses an auto detect system for a marine vessel in which the various associations and relationships between marine propulsion devices, gauges, sensors, and other components are quickly and easily determined. The system performs a method which automatically determines the number of marine propulsion devices on the marine vessel and, where needed, prompts the boat builder or marine vessel outfitter to enter various commands to identify particular marine propulsion devices with reference to their location on the marine vessel and to identify certain other components, such as gauges, with reference to both their location at a particular helm station and their association with a particular marine propulsion device.

U.S. Pat. No. 6,406,342 discloses a control handle for a tiller of an outboard motor is provided with a rotatable handle grip portion that includes an end surface which supports a plurality of push buttons that the operator of a marine vessel can depress to actuate certain control mechanisms and devices associated with the outboard motor. These push buttons include trim up and trim down along with gear selector push buttons in a preferred embodiment of the present invention.

U.S. Pat. No. 7,090,551 discloses a tiller arm provided with a lock mechanism that retains the tiller arm in an upwardly extending position relative to an outboard motor when the tiller arm is rotated about a first axis and the lock mechanism is placed in a first of two positions. Contact between an extension portion of the lock mechanism and the discontinuity of the arm prevents the arm from rotating downwardly out of its upward position.

U.S. Pat. No. 9,764,813 discloses a tiller for an outboard motor. The tiller comprises a tiller body that is elongated along a tiller axis between a fixed end and a free end. A throttle grip is disposed on the free end. The throttle grip is rotatable through a first (left handed) range of motion from an idle position in which the outboard motor is controlled at idle speed to first (left handed) wide open throttle position in which the outboard motor is controlled at wide open throttle speed and alternately through a second (right handed) range of motion from the idle position to a second (right handed) wide open throttle position in which the outboard motor is controlled at wide open throttle speed.

U.S. Pat. No. 9,783,278 discloses a tiller for an outboard motor. The tiller comprises a supporting chassis having a first end and an opposite, second end. A rotatable throttle grip is supported on the first end and a pivot joint is located at the second end. The pivot joint is configured to facilitate pivoting of the tiller at least into and between a horizontal position wherein the supporting chassis extends horizontally and a vertical position wherein the supporting chassis extends vertically. A top cover is located on the supporting chassis. The top cover and the supporting chassis together define an interior of the tiller. The top cover is located vertically on top of the supporting chassis when the tiller is in the horizontal position.

U.S. Pat. No. 9,789,945 disclose a tiller for an outboard motor. The tiller has a base bracket that is configured to be rotationally fixed with respect to the outboard motor, a chassis bracket that is coupled to the base bracket, and a locking arrangement. The locking arrangement is movable into and between a locked position, wherein the chassis bracket is locked to and rotates together with the base bracket, and an unlocked position, wherein the chassis bracket is freely rotatable with respect to the base bracket about a vertical axis when the tiller is in a horizontal position.

U.S. Pat. No. 10,246,173 discloses a tiller for an outboard motor having a manually operable shift mechanism configured to actuate shift changes in a transmission of the outboard motor amongst a forward gear, reverse gear, and neutral gear. The tiller also has a manually operable throttle mechanism configured to position a throttle of an internal combustion engine of the outboard motor into and between the idle position and a wide-open throttle position. An interlock mechanism is configured to prevent a shift change in the transmission out of the neutral gear when the throttle is positioned in a non-idle position. The interlock mechanism is further configured to permit a shift change into the neutral gear regardless of where the throttle is positioned.

SUMMARY

This Summary is provided to introduce a selection of concepts that are further described herein below in the Detailed Description. This Summary is not intended to identify key or essential features of the claimed subject matter, nor is it intended to be used as an aid in limiting the scope of the claimed subject matter.

According to one example, a tiller for an outboard motor powered by an engine includes a tiller body that is elongated along a longitudinal center axis between a proximal end and a distal end. A throttle grip is on the distal end of the tiller body. An idle speed control switch is located on the tiller body adjacent the throttle grip. A microcontroller is located inside the tiller body and is in signal communication with an engine controller of the engine. The idle speed control switch is a momentary switch configured to be selectively electrically connected to the microcontroller. In response to actuation of the idle speed control switch, the microcontroller sends a signal to the engine controller to change an idle speed of the engine.

According to another example, a tiller for an outboard motor powered by an engine includes a tiller body that is elongated along a longitudinal center axis between a proximal end and a distal end. A throttle grip is on the distal end of the tiller body. A switch is located on the tiller body adjacent the throttle grip. A microcontroller is located inside the tiller body, in signal communication with an engine controller of the engine, and is configured to be selectively electrically connected to the switch. An electronic display is on the tiller body, configured to be electrically connected to the microcontroller, and configured to display information about at least one of the tiller and the engine to a user.

BRIEF DESCRIPTION OF THE DRAWINGS

The present disclosure is described with reference to the following Figures. The same numbers are used throughout the Figures to reference like features and like components.

DETAILED DESCRIPTION

Figure 1:
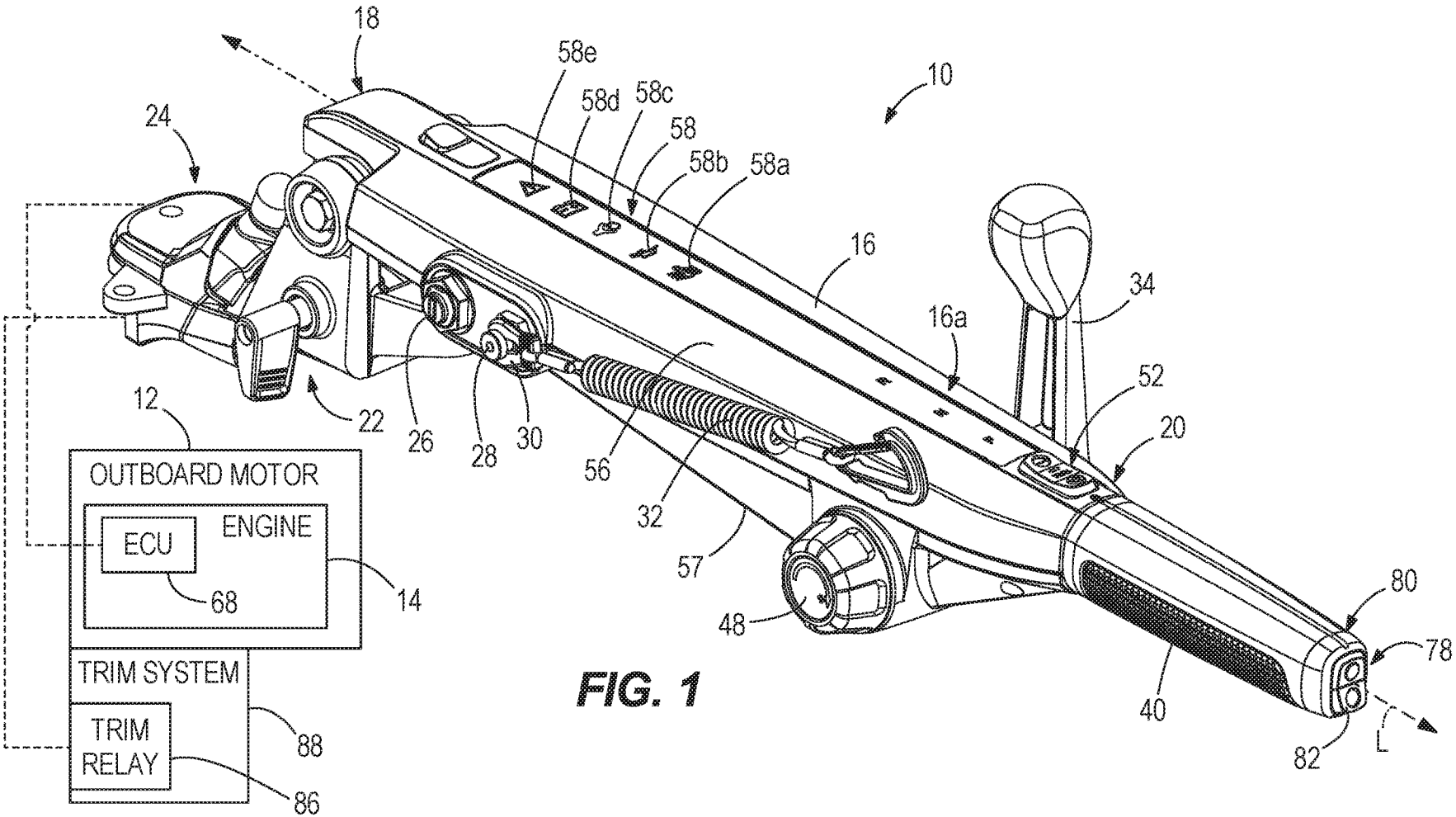
FIG. 1 illustrates a tiller for an outboard motor, which is shown schematically.

FIG. 1 illustrates a tiller 10 for an outboard motor 12 powered by an engine 14. The tiller 10 includes a tiller body 16 that is elongated along a longitudinal center axis L between a proximal end 18, which is closer to the outboard motor 12, and a distal end 20, which is further from the outboard motor 12 at least in the horizontal position of the tiller 10 shown here. The tiller body 16 includes a top cover 56 and a bottom chassis 57. The tiller 10 can be coupled to the outboard motor 12 by way of a steering bracket or other known assembly (not shown), as is known in the art. A tilt mechanism 22 and a yaw pivot joint 24 couple the proximal end 18 of the tiller body 16 to the steering bracket or other assembly on the outboard motor 12. The tilt mechanism 22 allows for manual pivoting and controlling of the position of the tiller 10 about a generally horizontal tilt axis, while the yaw pivot joint 24 is configured to allow for pivoting motion of the tiller 10 about a generally vertical axis, all as is known in the art.

Moving toward the distal end 20, an ignition switch 26 and lanyard stop switch 28 are provided on a lateral side of the tiller body 16. The ignition switch 26 accepts a key that can be twisted to turn the outboard motor 12 on and off, and twisted even further to start the engine 14. The lanyard stop switch 28 accepts a lanyard "key" 30 on one end of a lanyard 32, the other end of which can be attached to a user. If the user (with lanyard) moves too far from the tiller 10, the lanyard key 30 will pull away from and thereby actuate the lanyard stop switch 28, and the engine 14 will be stopped, all as is known.

Figure 2:
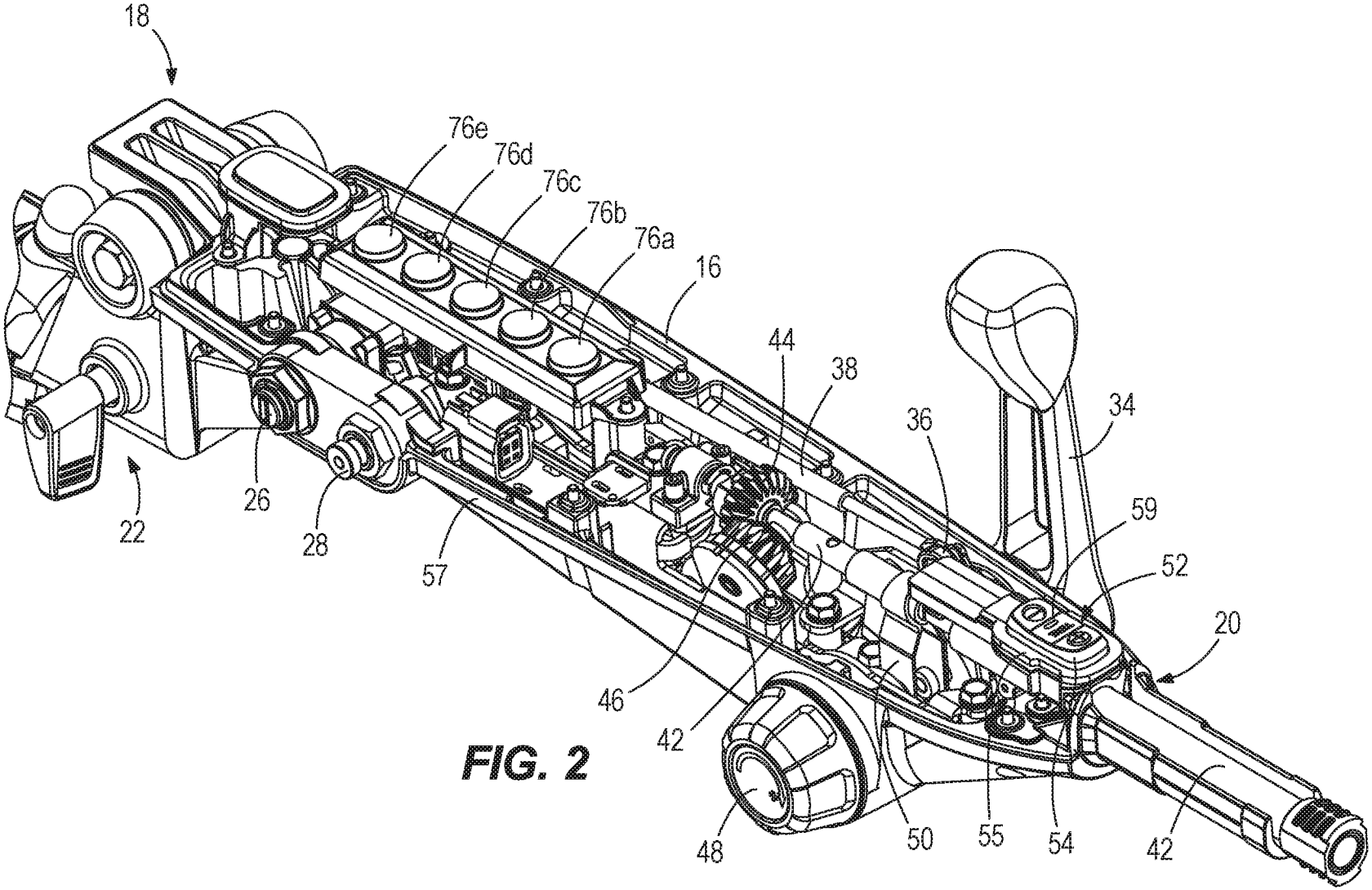
FIG. 2 illustrates the tiller of FIG. 1 with a top portion thereof removed.

Referring also to FIG. 2, on the opposite lateral side of the tiller body 16, the tiller 10 is provided with a shift handle 34 that is manually pivotable about a shift handle axis to thereby cause a shift change in a transmission of the outboard motor 12 between forward gear, reverse gear, and neutral gear. Rotation of the shift handle 34 about the shift handle axis causes commensurate rotation of a shift gear (not shown) inside the tiller body 16, which in turn causes rotation of a shift arm 36 coupled to the shift gear. As is conventional, movement of the shift arm 36 pushes or pulls on a push-pull cable 38, which causes corresponding shift changes in the transmission, as is conventional. The push-pull cable 38 and its connection to and operation with the transmission are well known to those having ordinary skill in the art and thus are not further described herein for brevity's sake.

Still referring to FIGS. 1 and 2, a throttle grip 40 is located on the distal end 20 of the tiller body 16. The throttle grip 40 is manually rotatable about the longitudinal center axis L to control a position of a throttle (not shown) of the engine 14. The throttle grip 40 is coupled to a throttle shaft 42 such as by way of a spline, key, and/or pin, and thus the throttle shaft 42 is rotatable with the throttle grip 40 about the longitudinal center axis L to move the throttle into and between an idle position and a wide open throttle position. Rotation of the throttle shaft 42 causes rotation of a throttle gear 44, which in turn rotates a meshed gear 46. The gear 46 is coupled to another push-pull cable (not shown). Rotation of the gear 46 pushes and/or pulls on the not shown push-pull cable, which causes corresponding changes in position of the throttle. The push-pull cable and its connection to and operation with the throttle are known to those having ordinary skill in the art and thus are not further described herein for brevity's sake. A locking knob 48 is also provided for manually locking a rotational position of the throttle grip 40 to thereby allow for hands-free operation of the throttle functionality of the tiller 10, as is also well known in the art. In the present example, rotation of the locking knob 48 squeezes a mounting sleeve 50, which mounts the throttle shaft 42 in the bottom chassis 57, about the throttle shaft 42 to prevent rotation of the throttle shaft 42 (and thus also of the throttle grip 40).

According to the present embodiment, a switch 52 is located on the tiller body 16 adjacent the throttle grip 40. The switch 52 is located just proximal of the distal end 20 of the tiller body 16, and is easily accessible by the user's finger while the user's hand remains on the throttle grip 40. In the present example, the switch 52 is an idle speed control switch. As is known in the art, idle speed control (also known as "low speed control" or "troll control") can be used to change an idle speed of the engine 14 while the throttle grip 40 is in an idle position. In other words, the idle speed control switch 52 can be used to adjust a low operational engine speed above the "true" idle speed of the engine 14. In some prior art designs, a mechanical rocker switch was used to actuate idle speed control, and a microcontroller and serial communication bus were integrated with the mechanical rocker switch. In contrast, in the present design, the idle speed control switch 52 is a momentary switch and is configured to be selectively electrically connected to a microcontroller located inside the tiller body 16. As will be described further herein below, such an assembly allows the microcontroller to be located remote from the idle speed control switch 52, and thus the idle speed control switch 52 can be packaged on the tiller body 16 in a manner that provides unique benefits not provided by prior art designs. Although in this example the momentary idle speed control switch 52 is a tactile switch, any other type of suitable momentary switch, or indeed any suitable locked switch, could be used depending on the packaging constraints of the tiller 10.

As shown in FIG. 1, the idle speed control switch 52 is located on a top face 16*a* of the tiller body 16 and is aligned with the longitudinal center axis L of the tiller body 16. Referring also to FIG. 2, in which the top cover 56 of the tiller body 16 has been removed to show the internal components of the tiller 10, a membrane 54 covers the electrical components of the idle speed control switch 52. The membrane 54 is coupled to the tiller body 16 in a watertight manner. For example, the membrane 54 can be attached to a mounting surface 55 for a circuit board (button board) supporting the idle speed control switch 52, and potting compound can be added to fill empty space around the switch 52 to further protect the electronic components. The top cover 56 (FIG. 1), which has an aperture sized and shaped to allow the membrane 54 to project there through, can be aligned and attached to the bottom chassis 57. The aperture in the top cover 56 fits closely around the membrane 54 in order to prevent intrusion of water into the tiller body 16. The membrane 54 can be made of an elastomeric material such as silicone that deforms when pressed by the user, in order to allow the tactile switches under the membrane 54 to move and thereby complete circuits on the circuit board below the membrane 54. Note that the idle speed control switch 52 of the present example includes two tactile switches, one to increase the idle speed of the engine 14 and one to decrease the idle speed of the engine 14 (see also 52*a*, 52*b* in FIG. 5), and the membrane 54 can be provided with + and − markings that label these switches accordingly. Note that in the present embodiment, the + marking and increase idle speed control switch 52*a* are closer to the distal end 20 of the tiller body 16 than the − marking and decrease idle speed control switch 52*b*. This provides intuitive speed control to the user, as the distal end 20 of the tiller body 16 is closer to the front of the marine vessel. The membrane 54 can further include an aperture or translucent portion that allows a light 59 (such as a light-emitting diode) on the button board to display whether the idle speed control feature is enabled.

Figure 5:
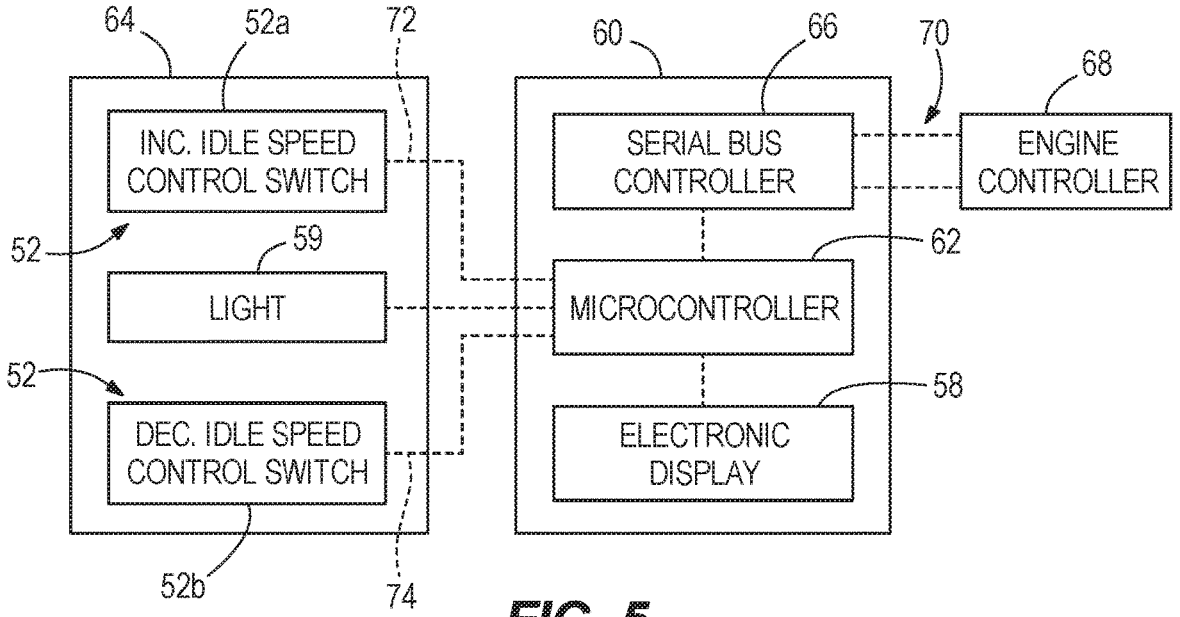
FIG. 5 is a schematic of electrical and signal connections between elements of the tiller and outboard motor for purposes of changing an idle speed of the outboard motor's engine.

The above-noted microcontroller is not shown in FIG. 1 or 2, but is located on a display circuit board that supports an electronic display 58 on the tiller body 16. A schematic of the display circuit board 60 and the microcontroller 62 and its connection to other components of the tiller 10 and engine 14 is shown in FIG. 5. As noted herein above, the idle speed control switch 52 includes an increase idle speed control switch 52*a* and a decrease idle speed control switch 52*b*, which are located on a circuit board 64 attached to the mounting surface 55, and over which the correspondingly marked portions of the membrane 54 are situated. Those having ordinary skill in the art will understand that if each of the switches 52*a* and 52*b* is electrically connected to a power source (not shown), such as a battery in the tiller 10 or on the outboard motor 12, closing of the switch 52*a* or 52*b* can complete an appropriately designed circuit including the switch 52*a* or 52*b*, the power source, and the microcontroller 62, thereby providing voltage to an input pin of the microcontroller 62. The microcontroller 62 is programmed to turn on the light 59 and command an idle speed control function of the engine 14, the latter of which is described below, in response to such voltage at the input pin.

Not only does the circuit board 60 support the microcontroller 62 and the electronic display 58, a serial bus controller 66 is also supported on the circuit board 60 and electrically connected to the microcontroller 62. Furthermore, the microcontroller 62 is in signal communication with an engine controller 68 of the engine 14, such as an engine control unit (ECU), which is also shown in FIG. 1. More specifically, with continued reference to FIG. 5, the serial bus controller 66 provides the signal communication between the microcontroller 62 and the engine controller 68 by way of a serial bus 70. In one example, the serial bus controller is a controller area network (CAN) controller that communicates with the engine controller 68 by way of a CAN bus. Upon voltage being applied to one of the input pins of the microcontroller 62 in response to actuation of the idle speed control switch 52, the microcontroller 62 is programmed to send a signal to the engine controller 68 (via the serial bus controller 66 and serial bus 70) to change an idle speed of the engine 14. The engine controller 68 can do this, for example, by commanding a change in position of an idle air bypass valve on the engine 14. Those having ordinary skill in the art are familiar with this way of changing the idle speed of the engine 14, and thus it will not be described further herein.

Using a microcontroller 62 and serial bus controller 66 to send such a command via the serial bus 70 avoids the need to provide analog electrical connections all the way from the idle speed control switch 52 to the engine controller 68. This reduces the number of wires running from the tiller 10 to the outboard motor 12 if there are additional signals that need to be communicated between the two, because only two signal connections (e.g., CAN+ and CAN−) need to be provided between the microcontroller 62 and the engine controller 68.

However, because the circuit board 60 that supports the microcontroller 62 is located closer to the proximal end 18 of the tiller body 16 than to the distal end 20 of the tiller body 16 (recall that the circuit board 60 is located under the electronic display 58), an electrical conductor is required to connect the idle speed control switch 52 to the microcontroller 62. As shown in FIG. 5, a first electrical conductor 72 selectively provides voltage to a first pin of the microcontroller 62 in response to closing of the increase idle speed control switch 52*a*, and a second electrical conductor 74 selectively provides voltage to a second pin of the microcontroller 62 in response to closing of the decrease idle speed control switch 52*b*. These electrical conductors 72, 74 only need to run through the tiller body 16, however, and not all the way to the engine controller 68. Furthermore, because the present example uses shallow tactile switches for the idle speed control switches 52*a*, 52*b*, there is room within the tiller body 16 below the circuit board 64 for the electrical conductors 72, 74 to curve from where they connect to the generally horizontally aligned circuit board 64 into an orientation in which they extend along the center longitudinal axis L toward the circuit board 60.

Another benefit of having the microcontroller 62 located remote from the idle speed control switch 52 and connected to the engine controller 68 via the serial bus 70 is that the electronic display 58 can be configured to be electrically connected to the microcontroller 62 and configured to display information about at least one of the tiller 10 and the engine 14 to a user. For example, the engine controller 68 already has information related to the temperature of the engine 14, an oil level in the engine 14, a voltage of a battery of the outboard motor 12, and whether the lanyard key 30 is correctly placed on/in the lanyard stop switch 28. This information can be conveyed to the microcontroller 62 via the serial bus 70 and serial bus controller 66, and the microcontroller 62 can be programmed to provide different displays via the electronic display 58 using this information. For example, referring to FIG. 1, the electronic display 58 is configured to display to the user at least one of the following: an indication 58*a* that the engine 14 is overheated (such as if the engine's temperature exceeds a predetermined threshold temperature); an indication 58*b* that the engine 14 needs oil (such as if the oil level is below a predetermined threshold level); and an indication 58*d* that a battery of the outboard motor 12 requires recharging (such as if the battery's voltage is below a predetermined threshold voltage). Note that either the engine controller 68 or the microcontroller 62 can be programmed to compare the sensed conditions of the outboard motor 12 and/or engine 14 to the noted thresholds to determine if an indication should be displayed.

The electronic display 58 may additionally or alternatively be configured to display to the user a general warning indication 58*e*, such as for example if there is an engine malfunction, low fuel, low cooling water pressure, or any other number of faults, also using information from the engine controller 68. The electronic display 58 may additionally or alternatively be configured to display to the user an indication 58*c* that the lanyard 32 is not connected to the tiller 10. This may be helpful information when a user tries to start the engine 14 by twisting the key in the ignition switch 26, but the engine 14 does not start because the user forgot to place or incorrectly placed the lanyard key 30 on the lanyard stop switch 28. Like the other indications 58*a*, 58*b*, 58*d*, and 58*e*, the indication 58*c* is displayed based on information from the engine controller 68; however, in an alternative embodiment, the indication 58*c* can be displayed in response a voltage being applied (or not being applied) to an input pin of the microcontroller 62, which input pin is electrically connected to the lanyard stop switch 28.

By comparison of FIGS. 1 and 2, it can be seen that the electronic display 58 of the present disclosure includes a plurality of lights, such as light-emitting diodes 76*a*-76*e*, connected to the circuit board 60. The LEDs 76*a-e* can be selectively lit by output voltage from the microcontroller 62 when a particular determination by the microcontroller 62 or the engine controller 68 is made, such as that one of the above-noted thresholds is not met or is exceeded or that the lanyard key 30 is not on the lanyard stop switch 28. The top cover 56 of the tiller body 16 can be stamped or otherwise cut to form symbols corresponding to each of the indications 58*a-e* described hereinabove. When a particular LED 76*a-e* corresponding to a particular symbol is lit, the indication 58*a-e* is displayed to the user. The cutouts in the top cover 56 may be filled with plastic or clear silicone to prevent intrusion of water into the tiller body 16. In other examples, the electronic display 58 comprises a liquid crystal display mounted to the circuit board 60 and visible through or projecting through the top cover 56 of the tiller body 16. In still other examples, the electronic display 58 comprises lights next to printed symbols on the top cover 56. Those having ordinary skill in the art will understand that many other forms of an electronic display controlled by a microcontroller can be incorporated into the present design, and that many other types of indications can be displayed about the status of the tiller 10 and/or outboard motor 12.

The assembly of the present disclosure therefore allows a single microcontroller 62 to be used both to send idle speed control signals to the engine controller 68 as well as to output information to a user via the electronic display 58. Meanwhile, the idle speed control switch 52 can be located remote from the microcontroller 62, near the user's hand, which is likely on the throttle grip 40 while the idle speed control function is being used. Because the idle speed control switch 52 is aligned with the center longitudinal axis L of the tiller body 16, the tiller 10 is easy to use for both left-handed and right-handed users. The idle speed control switch 52 is able to be located in this position, despite the throttle shaft 42 being located directly below the idle speed control switch 52 (see FIG. 2), due to the shallow nature of a tactile switch in comparison to a mechanical rocker switch, which is generally deeper even when not integrated with a microcontroller and serial bus controller. The location of the idle speed control switch 52 on the top face 16*a* of the tiller body 16, which can collect water, also requires a more watertight connection than a mechanical rocker switch typically provides, which watertight connection is provided by the membrane 54 over the tactile switches 52*a*, 52*b* as noted hereinabove.

Note that although the switch 52 at the distal end 20 of the tiller body 16 is described hereinabove as being for idle speed control, the switch 52 could be used for enabling any engine function that requires an analog signal to be generated in the tiller 10. For example, a trim command and/or an automatic trim command could be generated by actuation of the switch. In other examples, no electronic display 58 is provided, and/or the microcontroller 62 and serial bus controller 66 can be located elsewhere in the tiller 10. In still other examples, the idle speed control switch 52 (or other type of switch) is combined onto the same circuit board 60 as the microcontroller 62, serial bus controller 66, and electronic display 58.

Figure 3:
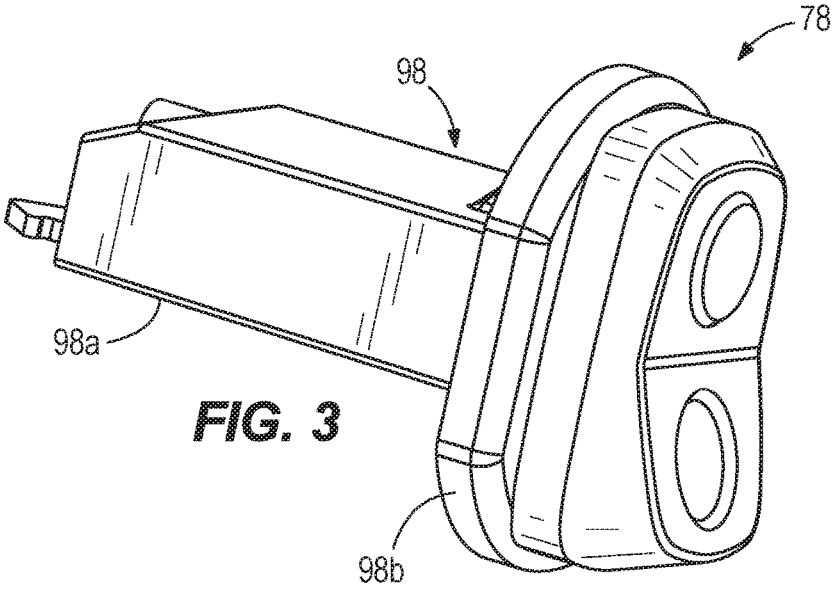
FIG. 3 illustrates a switch assembly for use in the tiller.
Figure 4:
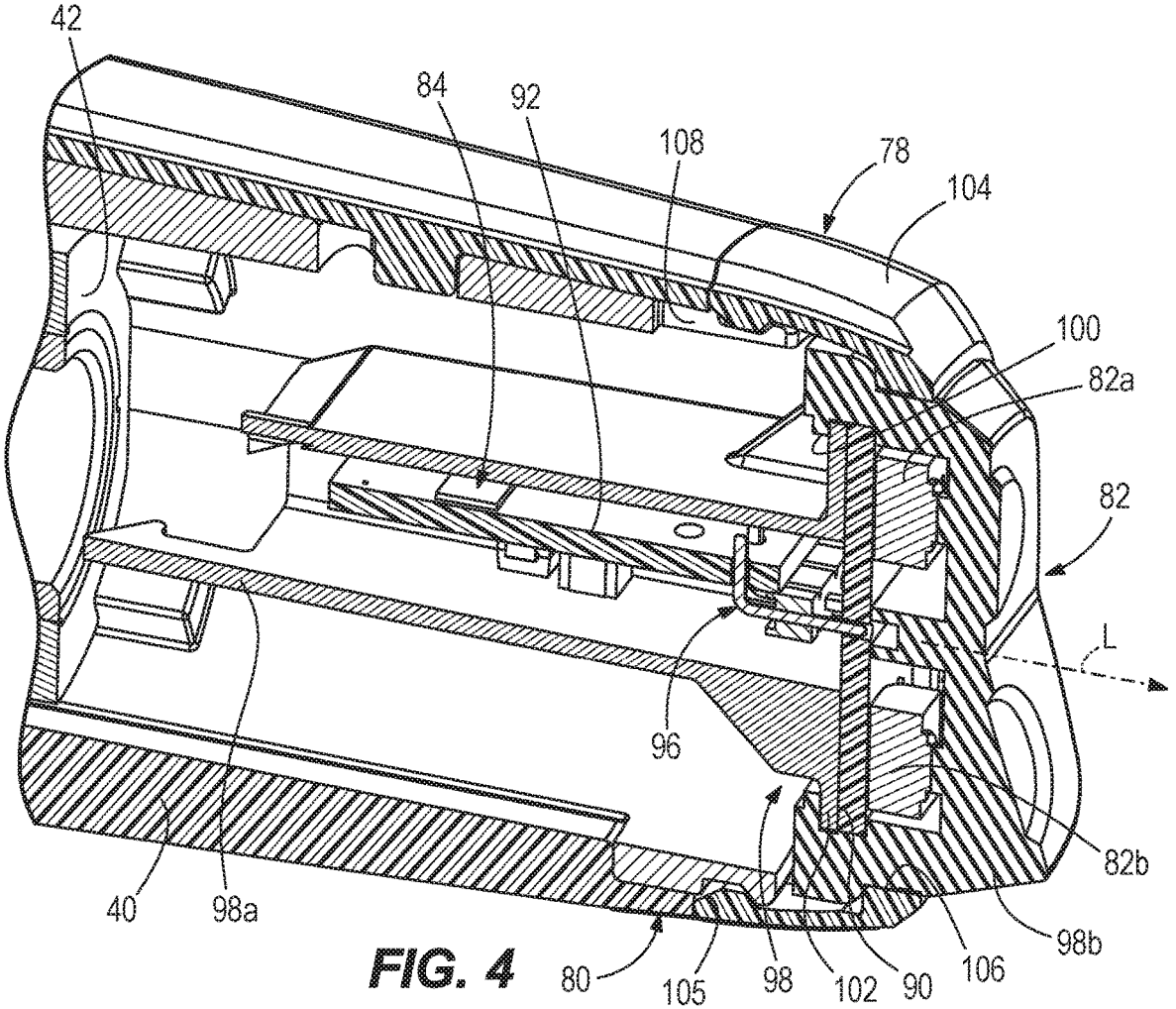
FIG. 4 illustrates a cross-section of the switch assembly of FIG. 3.

Referring again to FIG. 1, and now also to FIGS. 3 and 4, another switch assembly 78 (in this example, a trim switch assembly) is located at a distal end 80 of the throttle grip 40. As shown in FIG. 4, the trim switch assembly 78 comprises a momentary switch 82 and a driver 84. As shown in this example, the momentary switch 82 is a tactile switch. The driver 84 is configured to output current to activate a trim relay 86 on the outboard motor 12 in response to actuation of the momentary switch 82. Those having ordinary skill in the art understand that the trim relay 86 is part of a trim system 88 connected to the outboard motor 12 and configured to rotate the outboard motor 12 about a horizontal trim axis. The trim system 88 may include an electric motor and a hydraulic pump for providing hydraulic fluid to a trim cylinder, an electric motor coupled to an electric linear actuator, or an electric motor and a pneumatic pump providing air to a trim cylinder. Outboard motor trim systems are well known in the art and therefore will not be described further herein for purposes of brevity.

Figure 6:
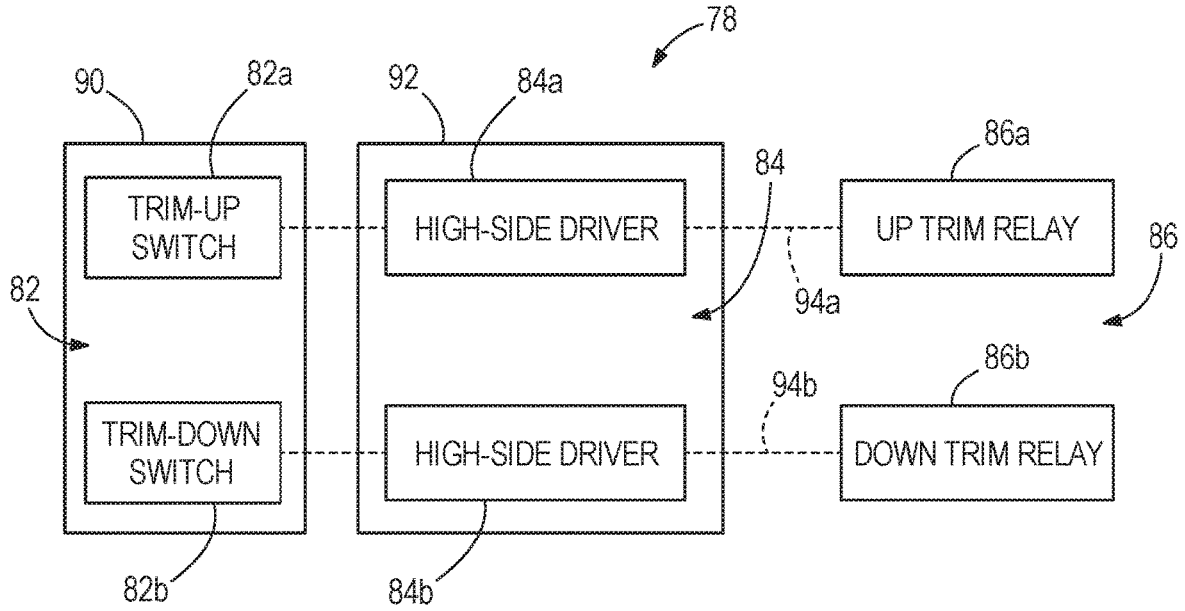
FIG. 6 is a schematic of electrical connections between elements of the tiller and outboard motor for purposes of changing a trim position of the outboard motor.

As shown in FIGS. 4 and 6, the trim switch assembly 78 further comprises a first circuit board 90 on which the momentary switch 82 is located and a second circuit board 92 on which the driver 84 is located. More specifically, the tactile momentary switch 82 comprises a trim-up tactile momentary switch 82*a* and a trim-down tactile momentary switch 82*b*, both on the first circuit board 90 (or "button board"). The trim-up momentary switch 82*a* is configured to be electrically connected to a high-side driver 84*a* on the second circuit board 92 (or "driver board"), and the trim-down momentary switch 82*b* is configured to be electrically connected to a high-side driver 84*b* on the second circuit board 92. The drivers 84*a*, 84*b* on the driver board 92 are configured to output current to activate the relay 86 on the outboard motor 12 in response to actuation of the tactile momentary switches 82*a*, 82*b*, such as when closure of one of the switches 82*a* or 82*b* electrically connects the respective driver 84*a* or 84*b* to a power source, such as a battery in the tiller 10 or on the outboard motor 12.

According to the present example, the tactile momentary switches 82*a*, 82*b* are rated to carry no more than 100 milliamps of current, and in one example are rated to carry only 50 milliamps of current. However, the trim system 88 will generally be configured such that more than 100 milliamps of current are required to activate the trim-up trim relay 86*a* or trim-down relay 86*b*. Thus, the drivers 84*a*, 84*b* connect the power source to the trim relay 86 in response to actuation of the tactile momentary switch 82*a* or 82*b*, thereby providing full power from the power source to the trim relay 86*a* or 86*b*. Electrical conductors 94*a*, 94*b* connect an output of each driver 84*a*, 84*b* to a respective input of each trim relay 86*a*, 86*b*. Although not shown in FIG. 2, these electrical conductors 94*a*, 94*b* run from the trim switch assembly 78 through the tiller body 16 and to the trim system 88 on the outboard motor 12.

As shown in FIGS. 3 and 4, the first circuit board 90 supporting the tactile momentary switches 82*a*, 82*b* is connected to the second circuit board 92 supporting the drivers 84*a*, 84*b* by a series of right angle connectors 96. The first and second circuit boards 90, 92 are oriented perpendicular to one another, with the first (button) board 90 being oriented perpendicular to the center longitudinal axis L of the tiller body 16 and the second (driver) board 92 being oriented parallel to the center longitudinal axis L. The trim switch assembly 78 further includes an assembly housing 98 holding the first (button) circuit board 90 and second (driver) circuit board 92. More specifically, the assembly housing 98 includes a first housing part 98*a*, for example made of plastic, housing the second driver board 92, and a second housing part 98*b*, for example a membrane made of an elastomeric material such as silicone. The first button board 90 is located between the end of the first housing part 98*a* and the second housing part 98*b*, the latter of which has a lip 100 that fits over a flange 102 on the first housing part 98*a*. A collar 104 connects the assembly housing 98 to the distal end 80 of the throttle grip 40 in a watertight manner. The collar 104 has an aperture 106 through which the second housing part 98*b* extends, which aperture 106 is sized and shaped to fit tightly around the second housing part 98*b*. The opposite end of the collar 104 has a lip 105 that snaps over an end of an annular insert 108 that projects from the distal end 80 of the throttle grip 40.

As shown in FIG. 4, a portion of the assembly housing 98 is located within the throttle grip 40. The second/driver board 92 is also at least partially located within the throttle grip 40. This allows for a compact design, in which extra space in the throttle grip 40, which is sized to comfortably fit a user's hand, can be filled with electronic components of the trim switch assembly 78. As shown in FIG. 3, the trim switch assembly 78 can be a manufactured as a pre-assembled part that can later be assembled into the distal end 80 of the throttle grip 40 by snapping the collar 104 in place there over. Note that in other examples, the button board 90 and driver board 92 could be provided in separate housings, but this would require separate waterproofing of each housing and electrical conductors therebetween.

Note that although the switch assembly 78 at the distal end 80 of the throttle grip 40 has hereinabove been described as a trim switch assembly, the switch assembly 78 could be any type of switch assembly suitable for inclusion on a tiller 10 that communicates with a relay on the outboard motor 12, such as a switch assembly for actuating a gas-assist tilt function or a back-up steering function of the outboard motor 12. The use of tactile switches in the switch assembly 78 allows for a compact design, as the button board 90, a small portion of the first housing part 98*a*, the second housing part 98*b*, and the collar 104 are the only portions of the tiller 10 that project beyond the throttle grip 40.

In the above description, certain terms have been used for brevity, clarity, and understanding. No unnecessary limitations are to be inferred therefrom beyond the requirement of the prior art because such terms are used for descriptive purposes and are intended to be broadly construed. The different systems and method steps described herein may be used alone or in combination with other systems and methods. It is to be expected that various equivalents, alternatives and modifications are possible within the scope of the appended claims.

What is claimed is:

1. A tiller for an outboard motor powered by an engine, the tiller comprising:

a tiller body that is elongated along a longitudinal center axis between a proximal end and a distal end;

a throttle grip on the distal end of the tiller body;

an idle speed control switch located on the tiller body adjacent the throttle grip;

a microcontroller located inside the tiller body and in signal communication with an engine controller of the engine;

an electronic display on the tiller body, configured to be electrically connected to the microcontroller, and configured to display information about at least one of the tiller and the engine to a user; and a circuit board supporting the microcontroller and the electronic display;

wherein the idle speed control switch is a momentary switch configured to be selectively electrically connected to the microcontroller; and wherein in response to actuation of the idle speed control switch, the microcontroller sends a signal to the engine controller to change an idle speed of the engine.

2. The tiller of claim 1, further comprising a serial bus controller supported on the circuit board and electrically connected to the microcontroller, wherein the serial bus controller provides the signal communication between the microcontroller and the engine controller.

3. The tiller of claim 2, wherein the electronic display is configured to display to the user at least one of the following:

a general warning indication;

an indication that a safety lanyard is not connected to the tiller;

an indication that the engine is overheated;

an indication that the engine needs oil; and an indication that a battery of the outboard motor requires recharging.

4. The tiller of claim 1, wherein the circuit board is located closer to the proximal end of the tiller body than to the distal end of the tiller body, and further comprising an electrical conductor connecting the idle speed control switch to the microcontroller.

5. The tiller of claim 1, wherein the idle speed control switch is located on a top face of the tiller body.

6. A tiller for an outboard motor powered by an engine, the tiller comprising:

a tiller body that is elongated along a longitudinal center axis between a proximal end and a distal end;

a throttle grip on the distal end of the tiller body;

an idle speed control switch located on the tiller body adjacent the throttle grip; and a microcontroller located inside the tiller body and in signal communication with an engine controller of the engine;

wherein the idle speed control switch is a momentary switch configured to be selectively electrically connected to the microcontroller;

wherein in response to actuation of the idle speed control switch, the microcontroller sends a signal to the engine controller to change an idle speed of the engine;

wherein the idle speed control switch is located on a top face of the tiller body; and wherein the idle speed control switch is aligned with the longitudinal center axis of the tiller body.

7. The tiller of claim 1, wherein the momentary switch is a tactile switch.

8. A tiller for an outboard motor powered by an engine, the tiller comprising:

a tiller body that is elongated along a longitudinal center axis between a proximal end and a distal end;

a throttle grip on the distal end of the tiller body;

an idle speed control switch located on the tiller body adjacent the throttle grip;

a microcontroller located inside the tiller body and in signal communication with an engine controller of the engine; and a membrane covering the idle speed control switch and coupled to the tiller body in a watertight manner;

wherein the idle speed control switch is a momentary switch configured to be selectively electrically connected to the microcontroller; and wherein in response to actuation of the idle speed control switch, the microcontroller sends a signal to the engine controller to change an idle speed of the engine.

9. A tiller for an outboard motor powered by an engine, the tiller comprising:

a tiller body that is elongated along a longitudinal center axis between a proximal end and a distal end;

a throttle grip on the distal end of the tiller body;

a switch located on the tiller body adjacent the throttle grip;

a microcontroller located inside the tiller body, in signal communication with an engine controller of the engine, and configured to be selectively electrically connected to the switch; and an electronic display on the tiller body, configured to be electrically connected to the microcontroller, and configured to display information about at least one of the tiller and the engine to a user;

a serial bus controller electrically connected to the microcontroller, wherein the serial bus controller provides the signal communication between the microcontroller and the engine controller; and a circuit board supporting the microcontroller, the electronic display, and the serial bus controller, wherein the circuit board is located closer to the proximal end of the tiller body than to the distal end of the tiller body.

10. The tiller of claim 9, wherein the switch is an idle speed control switch; and wherein in response to actuation of the idle speed control switch, the microcontroller sends a signal to the engine controller to change an idle speed of the engine.

11. The tiller of claim 10, wherein the idle speed control switch is located on a top face of the tiller body.

12. The tiller of claim 11, wherein the idle speed control switch is aligned with the longitudinal center axis of the tiller body.

13. The tiller of claim 9, wherein the switch is a momentary switch.

14. The tiller of claim 13, wherein the switch is a tactile switch.

15. A tiller for an outboard motor powered by an engine, the tiller comprising:

a tiller body that is elongated along a longitudinal center axis between a proximal end and a distal end;

a throttle grip on the distal end of the tiller body;

a switch located on the tiller body adjacent the throttle grip;

a microcontroller located inside the tiller body, in signal communication with an engine controller of the engine, and configured to be selectively electrically connected to the switch;

an electronic display on the tiller body, configured to be electrically connected to the microcontroller, and configured to display information about at least one of the tiller and the engine to a user; and a membrane covering the switch and coupled to the tiller body in a watertight manner.

16. The tiller of claim 9, wherein the electronic display is configured to display to the user at least one of the following:

a general warning indication;

an indication that a safety lanyard is not connected to the tiller;

an indication that the engine is overheated;

an indication that the engine needs oil; and an indication that a battery of the outboard motor requires recharging.

17. The tiller of claim 15, further comprising:

a serial bus controller electrically connected to the microcontroller, wherein the serial bus controller provides the signal communication between the microcontroller and the engine controller; and a circuit board supporting the microcontroller, the electronic display, and the serial bus controller, wherein the circuit board is located closer to the proximal end of the tiller body than to the distal end of the tiller body.

18. A tiller for an outboard motor powered by an engine, the tiller comprising:

a tiller body that is elongated along a longitudinal center axis between a proximal end and a distal end;

a throttle grip on the distal end of the tiller body;

a switch located on the tiller body adjacent the throttle grip;

a microcontroller located inside the tiller body, in signal communication with an engine controller of the engine, and configured to be selectively electrically connected to the switch; and an electronic display on the tiller body, configured to be electrically connected to the microcontroller, and configured to display information about at least one of the tiller and the engine to a user;

wherein the switch is an idle speed control switch;

wherein in response to actuation of the idle speed control switch, the microcontroller sends a signal to the engine controller to change an idle speed of the engine;

wherein the idle speed control switch is located on a top face of the tiller body; and wherein the idle speed control switch is aligned with the longitudinal center axis of the tiller body.

19. The tiller of claim 18, further comprising:

a serial bus controller electrically connected to the microcontroller, wherein the serial bus controller provides the signal communication between the microcontroller and the engine controller; and a circuit board supporting the microcontroller, the electronic display, and the serial bus controller, wherein the circuit board is located closer to the proximal end of the tiller body than to the distal end of the tiller body.

20. The tiller of claim 6, further comprising:

an electronic display on the tiller body, configured to be electrically connected to the microcontroller, and configured to display information about at least one of the tiller and the engine to a user; and a circuit board supporting the microcontroller and the electronic display.

21. The tiller of claim 8, further comprising:

an electronic display on the tiller body, configured to be electrically connected to the microcontroller, and configured to display information about at least one of the tiller and the engine to a user; and a circuit board supporting the microcontroller and the electronic display.

* * * * *